US011814819B2

(12) United States Patent
Lee et al.

(10) Patent No.: US 11,814,819 B2
(45) Date of Patent: Nov. 14, 2023

(54) CONSTRUCTION MACHINE BUCKET PART AND MANUFACTURING METHOD THEREFOR

(71) Applicant: DOOSAN INFRACORE CO., LTD., Incheon (KR)

(72) Inventors: Choung-Rae Lee, Incheon (KR); Sang-Min An, Incheon (KR)

(73) Assignee: DOOSAN INFRACORE CO., LTD, Incheon (KR)

( * ) Notice: Subject to any disclaimer, the term of this patent is extended or adjusted under 35 U.S.C. 154(b) by 1188 days.

(21) Appl. No.: 16/461,889

(22) PCT Filed: Nov. 17, 2017

(86) PCT No.: PCT/KR2017/013131

§ 371 (c)(1),
(2) Date: May 17, 2019

(87) PCT Pub. No.: WO2018/093207

PCT Pub. Date: May 24, 2018

(65) Prior Publication Data

US 2019/0368164 A1 Dec. 5, 2019

(30) Foreign Application Priority Data

Nov. 17, 2016 (KR) ..... 10-2016-0153132

(51) Int. Cl.
*E02F 9/28* (2006.01)
*B22D 19/06* (2006.01)
(Continued)

(52) U.S. Cl.
CPC ..... *E02F 9/285* (2013.01); *B22D 19/06* (2013.01); *C21D 5/04* (2013.01); *C21D 9/0068* (2013.01);
(Continued)

(58) Field of Classification Search
CPC ..... C21D 5/04; B22D 19/06; E02F 9/2808; E02F 9/2841; E02F 9/2875; E02F 9/2825; E02F 9/2816; E02F 9/285; E02F 9/2883
See application file for complete search history.

(56) References Cited

U.S. PATENT DOCUMENTS 2,608,111 A * 8/1952 Ratkowski ..... E02F 9/285 76/115
3,286,379 A * 11/1966 Benetti ..... E02F 9/285 172/747
(Continued)

FOREIGN PATENT DOCUMENTS

CN 101182719 A 5/2008
CN 201459801 U 5/2010
(Continued)

OTHER PUBLICATIONS

Extended European Search Report dated May 19, 2020 in connection with the counterpart European Patent Application No. EP17871423.4.
(Continued)

*Primary Examiner* — Adam J Behrens
(74) *Attorney, Agent, or Firm* — Hauptman Ham, LLP

(57) ABSTRACT

A construction machinery bucket part includes a body including a low alloy cast iron, and a wear resistant tip cast bonded to an end portion of the body and including a white cast iron. The construction machinery bucket part includes dissimilar materials, and has improved economic feasibility and wear resistance.

7 Claims, 6 Drawing Sheets

(51) Int. Cl.

| | |
|---|---|
| ***C21D 5/04*** | (2006.01) |
| ***C21D 9/00*** | (2006.01) |
| ***C22C 37/08*** | (2006.01) |
| ***C22C 37/10*** | (2006.01) |

(52) U.S. Cl.
CPC ..... *C22C 37/08* (2013.01); *C22C 37/10* (2013.01); *E02F 9/2825* (2013.01); *E02F 9/2883* (2013.01)

(56) References Cited

U.S. PATENT DOCUMENTS

| | | | | | |
|---|---|---|---|---|---|
| 3,805,423 | A * | 4/1974 | Engel | E02F 9/285 | 37/453 |
| 3,882,594 | A * | 5/1975 | Jackson | E21B 10/46 | 228/122.1 |
| 5,111,600 | A * | 5/1992 | Lukavich | E02F 9/285 | 37/460 |
| 5,502,905 | A * | 4/1996 | Cornelius | E02F 9/285 | 37/454 |
| 5,896,911 | A * | 4/1999 | Gegel | B22D 19/06 | 164/4.1 |
| 9,174,415 | B2 * | 11/2015 | Gong | C22C 9/08 | |
| 9,561,562 | B2 * | 2/2017 | Churchill | B22D 23/06 | |
| 2010/0275473 | A1 * | 11/2010 | Maher | C22C 37/08 | 37/453 |
| 2011/0259541 | A1 * | 10/2011 | Brom | B32B 15/01 | 164/80 |
| 2012/0131821 | A1 * | 5/2012 | Brufau Guinovart | E02F 3/8152 | 37/452 |
| 2013/0160335 | A1 * | 6/2013 | Maher | E02F 9/285 | 37/453 |
| 2017/0233986 | A1 * | 8/2017 | Yaniak | C22C 33/0292 | 37/452 |
| 2017/0241108 | A1 * | 8/2017 | Kokos | E21C 35/183 | |
| 2020/0270727 | A1 * | 8/2020 | Churchill | B22F 7/08 | |

FOREIGN PATENT DOCUMENTS

| | | | | | |
|---|---|---|---|---|---|
| CN | 204626506 | U | | 9/2015 | |
| JP | 2608106 | b2 | | 5/1997 | |
| JP | 2003-254096 | A | | 9/2003 | |
| JP | 2004218417 | A | * | 8/2004 | E02F 9/285 |
| KR | 20-1999-011857 | U | | 3/1999 | |
| KR | 10-0783100 | B1 | | 12/2007 | |
| KR | 100783100 | B1 | * | 12/2007 | E02F 9/2858 |
| KR | 10-2010-0131909 | A | | 12/2010 | |
| KR | 1020140145699 | A | | 12/2014 | |
| WO | WO-0213996 | A1 | * | 2/2002 | B22D 19/04 |
| WO | 2010136208 | A1 | | 12/2010 | |
| WO | WO-2015017894 | A1 | * | 2/2015 | E02F 3/40 |

OTHER PUBLICATIONS

International Search Report for PCT/KR2017/013131 dated Feb. 20, 2018, citing the above reference(s).

Chinese Office Action dated Nov. 5, 2020, in connection with the Chinese Patent Application No. 201780071342.4 citing the above reference(s).

* cited by examiner

CONSTRUCTION MACHINE BUCKET PART AND MANUFACTURING METHOD THEREFOR

CROSS REFERENCE TO RELATED APPLICATION

This present application is a national stage filing under 35 U. S.C § 371 of PCT application number PCT/KR2017/013131 filed on Nov. 17, 2017 which is based upon and claims the benefit of priority to Korean Patent Application No. 10-2016-0153132 filed on Nov. 17, 2016 in the Korean Intellectual Property Office. The disclosures of the above-listed applications are hereby incorporated by reference herein in their entirety.

TECHNICAL FIELD

The present invention relates to a bucket part for construction machinery and a method of manufacturing the same. More particularly, the present invention relates to a bucket part for construction machinery including dissimilar materials and a method of manufacturing the same.

BACKGROUND ART

For example, a wheel loader, a kind of construction machinery, may be civil engineering machinery used to excavate sand, aggregate, and the like, move and load it into a dump truck, and may include an arm in a front portion of a vehicle and a bucket in a distal portion of the arm for loading the sand or aggregate.

The bucket may be manufactured of a steel plate having a high hardness in order to improve wear resistance. However, since the bucket is manufactured by welding, there a limit to mix carbon or alloy elements in order to secure weldabilty, and thus, it may be difficult to obtain a desired hardness value. Thus, instead of welding, a cast steel part having high hardness such as a tooth point, a shroud, a cutter, etc, may be combined with the bucket. However, in case of the part, life time still has limits due to wear, and periodic replacement is required. When the replacement cycle for the part is very short, maintenance costs and working efficiency may be deteriorated.

For example, Utility Model Document 1 discloses that in order to increase wear resistant lifetime of a tooth point coupled with a bucket, tungsten carbide having high hardness is arc welded.

PRIOR ART DOCUMENT

<Utility Model Document>

1. Korean Utility Model Publication No. 1999-011857 (Mar. 25, 1999)

DISCLOSURE OF THE INVENTION

Problems to be Solved

An object of the present invention provides a bucket part for construction machinery having excellent mechanical properties.

Another object of the present invention provides a method of manufacturing the bucket part for construction machinery.

Means to Solve the Problems

According to example embodiments, a bucket part for construction machinery includes a body including a low alloy cast iron, and a wear resistant tip cast bonded to an end portion of the body and including a white cast iron.

In example embodiments, the low alloy cast iron of the body includes carbon in a range from about 0.25 weight percent to about 0.36 weight percent based on a total weight of the body.

In example embodiments, the body may have Brinell hardness (HB) of about from 490 to 550, and the wear resistant tip may have Rockwell hardness (HRC) of from 60 to 65

In example embodiments, the bucket part for construction machinery may be provided as a tooth point, a shroud or a cutter.

In example embodiments, the body includes an inserting column in a bottom surface, and the wear resistant tip may include a hole in a middle portion. The wear resistant tip may be combined with the bottom surface of the body such that the inserting column is inserted into the hole.

In example embodiments, an upper surface of the wear resistant tip forms a cast bonding surface with the body, and the upper surface of the wear resistant tip may have a convex curve In example embodiments, a thickness of the inserting column may increase gradually away from a surface of the body.

In example embodiments, the wear resistant tip includes a first wear resistant tip inserted into a bottom surface of the body and combined with the body through a hole formed therein, and a second wear resistant tip inserted into an upper surface of the body and having a rod shape.

In example embodiments, the white cast steel may includes carbon (C) in a range from about 2.3 weight percent to about 3.3 weight percent, chrome (Cr) in range from about 15 weight percent to about 25 weight percent, silicon (Si) in a range from about 0.4 weight percent to about 1.0 weight percent, manganese (Mn) in a range from about 0.6 weight percent to about 1.0 weight percent, molybdenum (Mo) in a range from about 0.6 weight percent to about 1.0 weight percent, nickel (Ni) in a range from about 0.4 weight percent to about 0.8 weight percent, copper (Cu) in a range from about 0.0 weight percent to about 0.3 weight percent, inevitable impurities, and a remainder of iron (Fe) based on a total weight of the wear resistant tip.

According to example embodiments, in a method of manufacturing a bucket part for construction machinery, a wear resistant tip is formed using a white cast iron, the white cast iron including carbon (C) in a range from about 2.3 weight percent to about 3.3 weight percent, chrome (Cr) in range from about 15 weight percent to about 25 weight percent, silicon (Si) in a range from about 0.4 weight percent to about 1.0 weight percent, manganese (Mn) in a range from about 0.6 weight percent to about 1.0 weight percent, molybdenum (Mo) in a range from about 0.6 weight percent to about 1.0 weight percent, nickel (Ni) in a range from about 0.4 weight percent to about 0.8 weight percent, copper (Cu) in a range from about 0.0 weight percent to about 0.3 weight percent, inevitable impurities, and a remainder of iron (Fe) based on a total weight of the wear resistant tip. The wear resistant tip is fastened to a mold of a part for construction machinery. A molten low alloy cast iron is tapped into the mold to form a body cast bonded to the wear resistant tip, the low alloy cast iron including carbon (C) in a range from about 0.25 weight percent to about 0.36 weight percent based on a total weight of the body In example embodiments, the method may further include, after forming the wear resistant tip, performing a full annealing process under a temperature of from 940° C. to 980° C.

In example embodiments, the method may further include, after tapping the molten low alloy cast iron to form the body, sequentially performing a quenching process under a temperature of from 900° C. to 950° C. and a tempering process under a temperature of from 180° C. to 250° C.

Effects of the Invention

According to example embodiments, a bucket part for construction machinery may include a wear resistant tip mounted on a body by a cast bonding process, the body including a low alloy cast iron. The wear resistant tip may be formed of an inexpensive white cast iron having excellent hardness. Accordingly, the bucket part for construction machinery may include dissimilar materials, and may have excellent wear resistance for the price and extended part replacement period, and thus, working efficiency of the construction machinery may be improved and maintenance costs may be reduced.

However, the effect of the invention may not be limited thereto, and may be expanded without being deviated from the concept and the scope of the present invention.

BEST MODE FOR CARRYING OUT THE INVENTION

Figure 1:
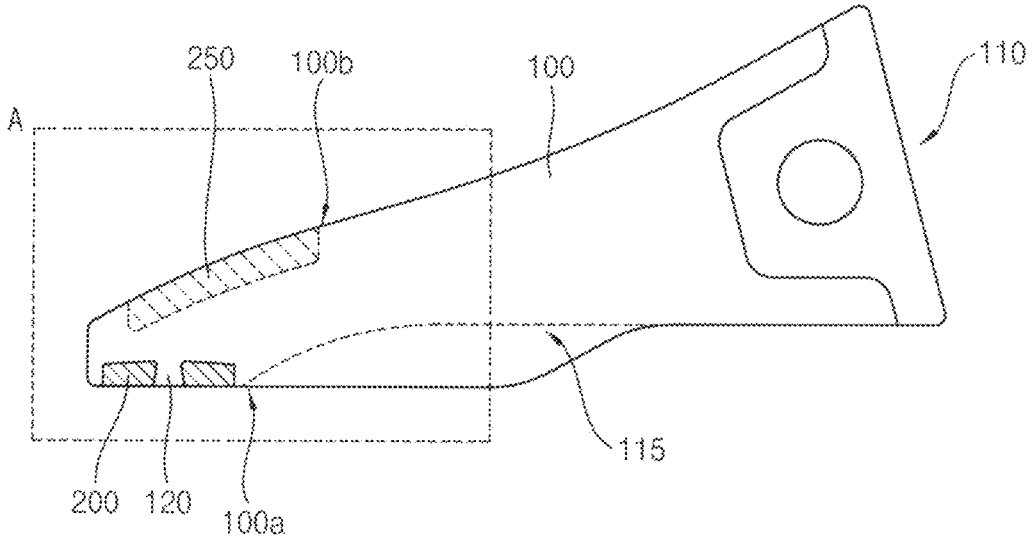
FIG. 1 is a side view illustrating a bucket part for construction machinery in accordance with example embodiments.

Various example embodiments will be described more fully hereinafter with reference to the accompanying drawings, in which example embodiments are shown. Example embodiments may, however, be embodied in many different forms and should not be construed as limited to example embodiments set forth herein.

Since many modifications are possible in example embodiments, a few example embodiments will be described with reference to the accompanying drawings. However, many modifications are possible in example embodiments without materially departing from the novel teachings and advantages of the present invention. Accordingly, all such modifications are intended to be included within the scope of the present inventive concepts.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Use of the term "about" generally describes values either above or below the stated value such as content, concentration, etc, in a range of approximately +/−.

Use of the term "remainder" generally describes a remaining amount except the stated elements, however, if additional other elements are included, the terms may be construed variably.

Some embodiments may be disclosed in a range format. It will be understood that descriptions on the range disclose all possible sub-ranges as well as individual numerical values in the range.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
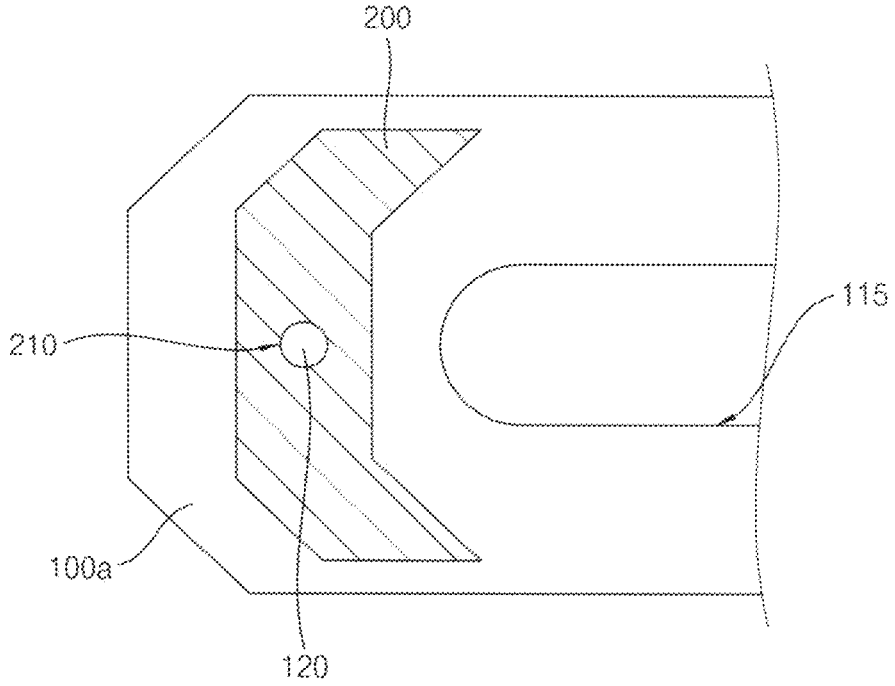
FIGS. 2, 3 and 4 are a bottom view, a cross-sectional view and a front view illustrating the "A" portion in FIG. 1 respectively.
Figure 3:
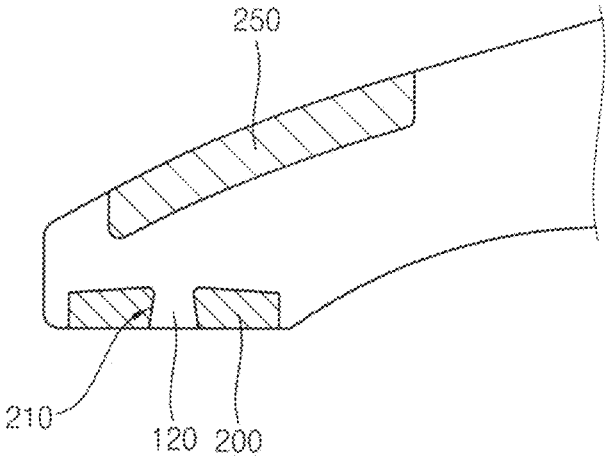
Figure 4:
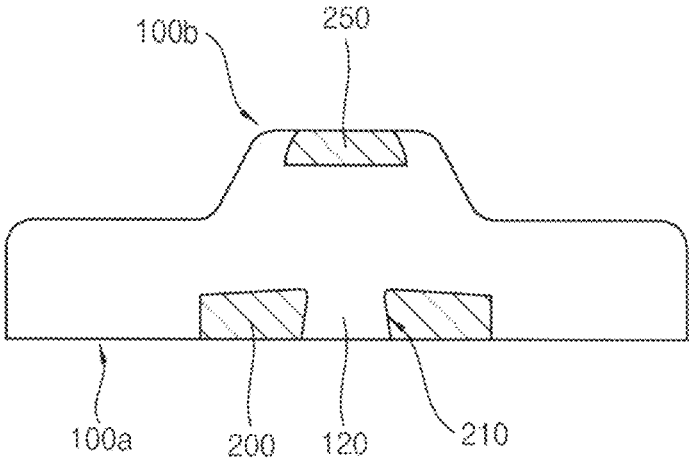

FIG. 1 is a side view illustrating a bucket part for construction machinery in accordance with example embodiments. FIGS. 2, 3 and 4 are a bottom view, a cross-sectional view and a front view illustrating the "A" portion in FIG. 1 respectively.

For example, the bucket part for construction machinery may be used for a tooth point coupled with a bucket of construction machinery.

In example embodiments, the bucket part for construction machinery may include a body 100 and a wear resistant tip (for example, 200, 250) provided in the body 100. At least one wear resistant tip may be provided, and in FIG. 1, the bucket part for construction machinery including the wear resistant tip with a first wear resistant tip 200 and a second wear resistant tip 250 may be exemplarily illustrated.

An insertion portion 110 may be formed in a first end portion of the body 100. A tooth adapter of the bucket of the construction machinery may be inserted into the insertion portion 110. The bucket part for construction machinery such as the tooth point may be installed fixedly in the bucket (for example, lip plate) of the construction machinery via the tooth adapter.

A second end portion (shown by "A") of the body may include a first surface 100*a* and a second surface 100*b*. The first surface 100*a* and the second surface 100*b* may be referred to as a bottom surface and an upper surface of the second end portion of the body 100 respectively.

In some example embodiments, the first surface 100*a* may be substantially even. As illustrated in FIG. 2, a concave portion 115 may be formed in the first surface 110*a* of the second end portion. The second surface 100*b* may have a substantially convex curve.

In example embodiments, the body 100 may include a low alloy cast iron. In some example embodiments, the body 100 may be formed of the low alloy cast iron including carbon (C) in a range from about 0.25 weight percent to about 0.36 weight percent based on a total weight.

Examples of the alloy may be manganese (Mn), silicon (Si), copper (Cu), aluminum (Al), chrome (Cr), etc.

In example embodiments, the first wear resistant tip 200 may be provided in the first surface 100*a* of the body 100. The first wear resistant tip 200 may have a hole 210 therein. An inserting column 120 may be inserted into the hole 210 of the first wear resistant tip 200 in the first surface 100*a* of the body 100. Accordingly, a fastening force to the body 100 may be increased.

In example embodiments, the body 100 may include at least one seating portion. The seating portion may be a portion in which the wear resistant tip is provided, and FIG. 1 represents an embodiment where the seating portion include a first recess 130 and a second recess 240. The inserting column 120 may be formed to protrude from an inner surface of the first recess 130 which is formed in the first surface 100*a*. The inserting column 120 may have a pillar shape with a uniform thickness (diameter). Alternatively, the inserting column 120 may have a shape whose thickness increases gradually away from the inner surface of the first recess 130. As a distal portion of the inserting column 120 is formed to be greater than a proximal portion of the inserting column 120, the first wear resistant tip 200 may be prevented more effectively from detaching from the body 100. Although it is not illustrated in the figures, an inner side surface of the first recess 130 is formed to be inclined such that a width of the first recess 130 decreases gradually toward the distal portion of the inserting column, to thereby improve a binding force with the first wear resistant tip 200.

In some example embodiments, the bucket part for construction machinery may further include the second wear resistant tip 250. The second wear resistant tip 250 may be provided in the second surface 100*b* of the body 200. For example, the second wear resistant tip 250 may a rod shape buried in the second recess 240.

In some example embodiments, an upper surface of the second wear resistant tip 250 may have a convex curve along a profile of the second surface 100*b*.

In example embodiments, the wear resistant tip 200, 250 may include a white cast iron. In some example embodiments, the wear resistant tip 200, 250 may be formed of the white cast steel including carbon (C) in a range from about 2.3 weight percent to about 3.3 weight percent, chrome (Cr) in range from about 15 weight percent to about 25 weight percent, silicon (Si) in a range from about 0.4 weight percent to about 1.0 weight percent, manganese (Mn) in a range from about 0.6 weight percent to about 1.0 weight percent, molybdenum (Mo) in a range from about 0.6 weight percent to about 1.0 weight percent, nickel (Ni) in a range from about 0.4 weight percent to about 0.8 weight percent, copper (Cu) in a range from about 0.0 weight percent to about 0.3 weight percent, inevitable impurities, and a remainder of iron (Fe) based on a total weight.

In some example embodiments, the impurities may further include non-metallic impurities such as phosphorous (P), sulfur (S), etc.

Figure 5:
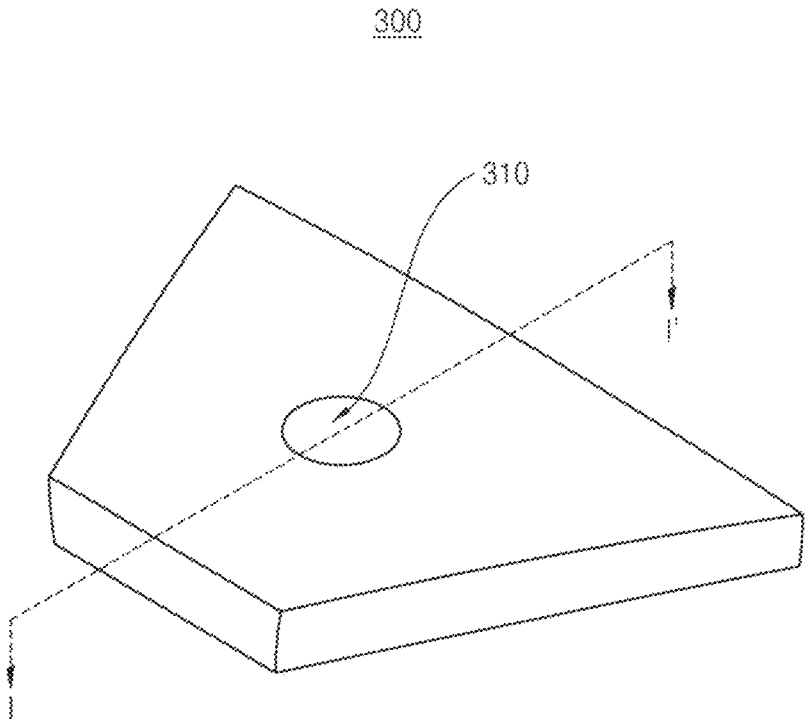
FIGS. 5 and 6 are a perspective view and a cross-sectional view illustrating a wear resistant tip in accordance with example embodiments.
Figure 6:
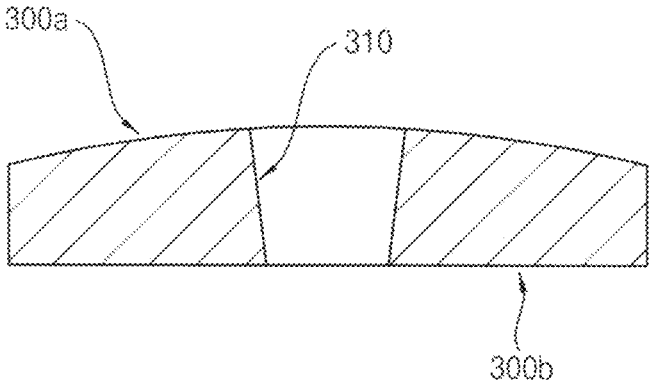

FIGS. 5 and 6 are a perspective view and a cross-sectional view illustrating a wear resistant tip in accordance with example embodiments. For example, FIGS. 5 and 6 illustrate the above mentioned first wear resistant tip.

Referring to FIGS. 5 and 6, a wear resistant tip 300 may have a substantially polygonal plane. As illustrated in FIG. 5, the wear resistant tip 300 may include, for example, an upper surface and/or lower surface of a trapezoidal shape. However, the shape of the wear resistant tip 300 may not be limited thereto, and as illustrated in FIG. 2, the wear resistant tip may have a concave polygonal plane of a boomerang shape.

As illustrated in FIG. 5, the wear resistant tip 300 may include a hole 310 in a middle portion, and the inserting column 120 of the body 100 may be inserted into the hole 310 as described with reference to FIGS. 2, 3 and 4.

As illustrated in FIG. 6, the wear resistant tip 300 may include a first surface 300*a* and a second surface 300*b*. The first surface 300*a* and the second surface 300*b* may be an upper surface and a bottom surface of the wear resistant tip 300 respectively.

In example embodiments, the first surface 300*a* may have a substantially convex curve. When the wear resistant tip is inserted into the body 100, the first surface 300*a* may make contact with the surface of the body 100. The first surface 300*a* may be a cast bonding surface which is cast bonded to the first recess 130 of the seating portion of the wear resistant tip 300, and the first surface 300*a* may be formed to be convex, and thus, a fastening force to the body 100 may be increased to prevent detaching of the wear resistant tip 300.

In some example embodiments, the second surface 300*b* may be substantially even. The second surface 300*b* may be exposed to surrounding environment of the bucket part for construction machinery, and may be exposed to wearing environment during work.

As mentioned above, the bucket part for construction machinery may include dissimilar materials which include the body 100 of the low alloy cast iron and the wear resistant tip 200, 250 of the white cast iron. The wear resistant tip 200, 250 including the relatively inexpensive white iron having an excellent hardness may be provided in the end portion which requires wear resistance reinforcement during construction work, to thereby extend replacement period and improve work efficiency of the construction machinery.

The bucket part for construction machinery may be used for a tooth point as described above. However, the use of the bucker part for construction machinery may not be limited thereto, and may be applied to various parts such as shroud, cutter, etc.

Figure 7:
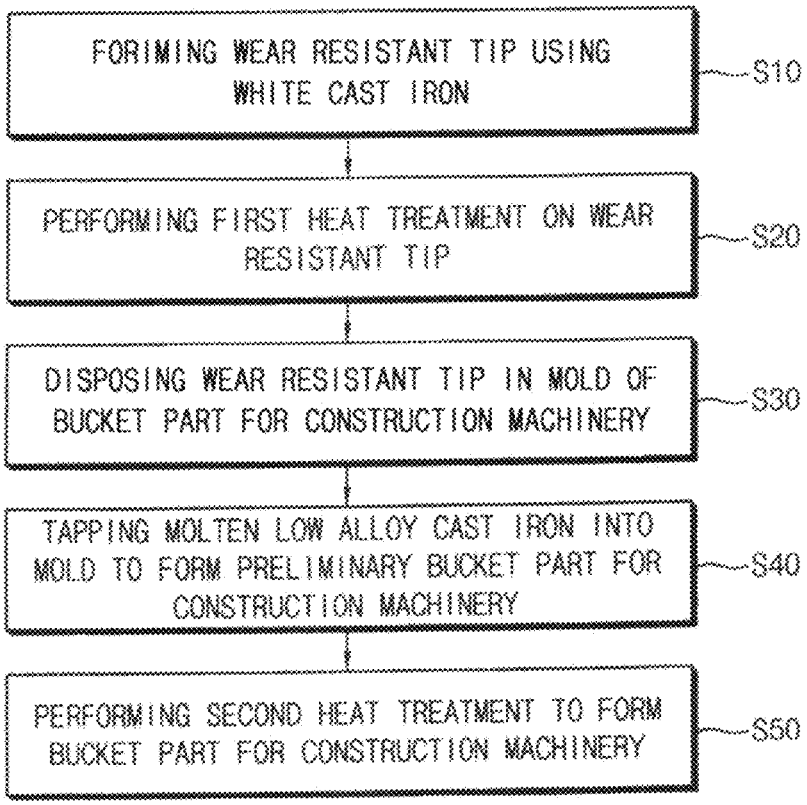
FIG. 7 is a flow chart illustrating a method of manufacturing a bucket part for construction machinery in accordance with example embodiments.

FIG. 7 is a flow chart illustrating a method of manufacturing a bucket part for construction machinery in accordance with example embodiments.

Referring to FIG. 7, in step S10, a wear resistant tip may be formed using a white cast iron.

As described above, the wear resistant tip may be formed of the white cast steel including carbon in a range from about 2.3 weight percent to about 3.3 weight percent, chrome in range from about 15 weight percent to about 25 weight percent, silicon in a range from about 0.4 weight percent to about 1.0 weight percent, manganese in a range from about 0.6 weight percent to about 1.0 weight percent, molybdenum in a range from about 0.6 weight percent to about 1.0 weight percent, nickel in a range from about 0.4 weight percent to about 0.8 weight percent, copper in a range from about 0.0 weight percent to about 0.3 weight percent, inevitable impurities, and a remainder of iron (Fe) based on a total weight.

Carbon and Chrome may form, for example, $M_7C_3$ carbide (for example, carbide) as a main component, to thereby improve hardness of the white cast iron and wear resistance. However, in case that a combination of carbon and chrome is not proper, an amount of the $M_7C_3$ carbide may be increased excessively to increase brittleness, or the amount of the $M_7C_3$ carbide may be insufficient to deteriorate the wear resistance.

If an amount of chrome is less than about 15 wt %, the amount of the $M_7C_3$ carbide may be decreased excessively and thus the wear resistance improvement effect may not be sufficiently achieved. On the other hand, if the amount of chrome exceeds about 25 wt %, the amount of the $M_7C_3$ carbide may be increased excessively and thus brittleness may be drastically increased.

In some example embodiments, when the amount of chrome is about 2.3 wt %, a minimum amount of carbon may be about 25 wt % which can obtained improved hardness by forming the $M_7C_3$ carbide. If the amount of carbon exceeds about 3.3 wt %, the amount of carbon distributed in a matrix may be increased relatively compared to the amount of the $M_7C_3$ carbide formed by chrome of about 15 wt %, so that ferrite may be formed in the matrix, for example, properties of holding the carbide may be decreased in comparison with austenite and thus the wear resistance may be reduced.

The white cast iron for forming the wear resistant tip may include silicon in a range from about 0.4 wt % to about 1.0 wt % based on the total weight. If the amount of silicon is less than about 0.4 wt %, castability of the white cast iron may be deteriorated, while if the amount of silicon exceeds about 1.0 wt %, by-products such as silicon oxide ($SiO_2$) may be formed during the casting and thus ductility of the white iron may be deteriorated.

The white cast iron for forming the wear resistant tip may include manganese in a range from about 0.6 wt % percent to about 1.0 wt %. If the amount of manganese is less than about 0.6 wt %, a precipitation of $M_3C$ may not proceed sufficiently while performing a following full annealing process. If the amount of manganese exceeds about 1.0 wt %, crack or deformation of the white cast iron may be caused during a following quenching process.

The white cast iron for forming the wear resistant tip may include molybdenum in a range from about 0.6 wt % to about 1.0 wt %. Molybdenum may be alloy element which forms carbide together with chrome and can prevent tempering brittleness, and if the amount of molybdenum is less than about 0.6 wt %, the effect of preventing tempering brittleness may not be obtained. If the amount of molybdenum exceeds about 1.0 wt %, the amount distributed to the matrix besides the carbide formation may be increased and thus brittleness may be increased.

Nickel may be added for forming the white cast iron to increase ductility of the matrix and refine the matrix structure. Nickel in a range from about 0.4 wt % to about 0.8 wt % based on the total weight of the white cast iron may be added. If the amount of nickel is less than about 0.4 wt %, the effect of the ductility increase and refinement of the matrix structure may not be obtained sufficiently. If the amount of nickel exceeds about 0.8 wt %, nickel may increase hardenability together with chrome and molybdenum and thus the effect of the ductility increase may be reduced.

Copper may be added to strengthen the matrix structure. For example, copper may solid solution strengthen austenite or ferrite to improve yield strength. Copper in a range from about 0 wt % to about 0.3 wt % based on the total weight of the white cast iron may be added. If the amount of copper exceeds about 0.3 wt %, fine precipitation hardening may be caused, and elongation may be drastically deteriorated.

Iron may be added as the remainder of the white cast iron. In some example embodiments, for example, non-metallic impurities such as sulfur may be further added to the remainder.

In step S20, a first heat treatment may be performed on the wear resistant tip. In example embodiments, the first heat treatment may include a full annealing process which is performed under a temperature of from about 940° C. to about 980° C. (for example, for about 3 hours). The ferrite in the matrix may be precipitation transformed into $M_3C$ by the full annealing process to thereby improve the wear resistance. Additionally, the matrix structure may be austenitenized to strengthen the properties of holding the carbide.

Then, in step S30, the full annealing processed wear resistant tip may be deposited in a mold of a bucket part for construction machinery (for example, tooth point).

For example, in step S40, a molten low alloy cast iron may be tapped into the mold, to form a preliminary bucket part for construction machinery.

The molten low alloy cast iron may be injected to form a body 100 (see FIG. 1) of the bucket part for construction machinery. As described above, the molten low alloy cast iron may includes carbon in a range from about 0.25 wt % to about 0.36 wt % based on a total weight.

For example, the molten low alloy cast iron of the temperature of from about 1,550° C. to about 1,650° C. may be injected and then cooled to be molded with the wear resistant tip, to form the preliminary bucket part for construction machinery including the body formed of the low alloy cast iron.

For example, as described with reference to FIG. 2 or FIG. 5, the wear resistant tip may have a hole (210, 310), and a surface of the wear resistant tip combined with the low alloy cast iron may be formed to have a convex curve. Accordingly, a fastening force with the low alloy cast iron may be increased to prevent detaching of the wear resistant tip.

Then, in step S50, a second heat treatment may be performed on the preliminary bucket part for construction machinery to form a bucket part for construction machinery.

In example embodiments, the second heat treatment may include a quenching process and a tempering process performed sequentially. The second heat treatment may be performed to adjust hardness of the bucket part for construction machinery to a desired range.

In some example embodiments, the quenching process may be performed under a temperature of from about 900° C. to about 950° C. Then, the tempering process may be performed under a temperature of from about 180° C. to about 250° C.

By the above mentioned processes, the bucket part for construction machinery including the body of low alloy cast iron, and the wear resistant tip of white cast iron may be manufactured.

In some example embodiments, through the second heat treatment, hardness of the body including low alloy cast iron may be adjusted to have Brinell hardness (HB) of about from about 490 to about 550, and hardness of the wear resistant tip including the white cast iron may be adjusted to have Rockwell hardness (HRC) of from about 60 to about 65.

Thus, the bucket part for construction machinery may be manufactured to include dissimilar materials and material properties to thereby improve wear resistance in a specific region.

Hereinafter, properties of a bucket part for construction machinery in accordance with example embodiments will be explained with reference to particular experimental examples.

Experimental Examples

Wear resistant tips including a white cast iron according to examples and comparative examples were manufactured based on compositions and heat treatment conditions listed in Table 1 below. In particular, in Comparative Example 1 heat treatment was omitted, and in other Comparative Examples and Examples a full annealing process was performed under a temperature of 960° C. for 3 hours.

Then, Green sand casting process may be performed using low alloy cast iron including carbon of 0.30 wt % to form a body combined with the wear resistant tip, to form a tooth point including dissimilar materials. A quenching process may be performed on the tooth point under a temperature of 910° C., and a tempering process may be performed under a temperature of 210° C.

Figure 8:
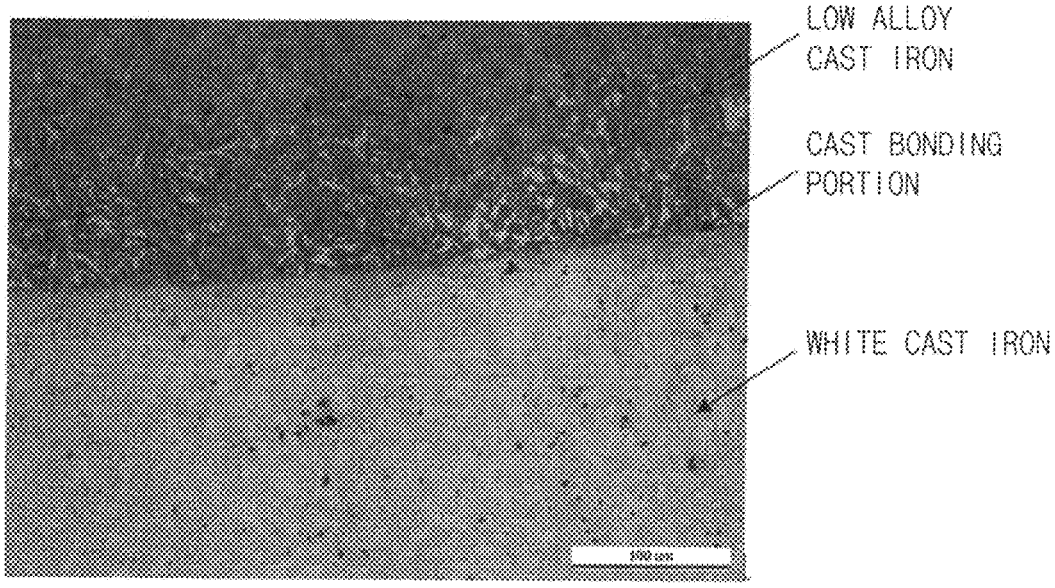
FIG. 8 is an image illustrating microstructures of cast bonding portion between a wear resistant tip and a body of a bucket part for construction machinery in accordance with example embodiments.
Figure 9:
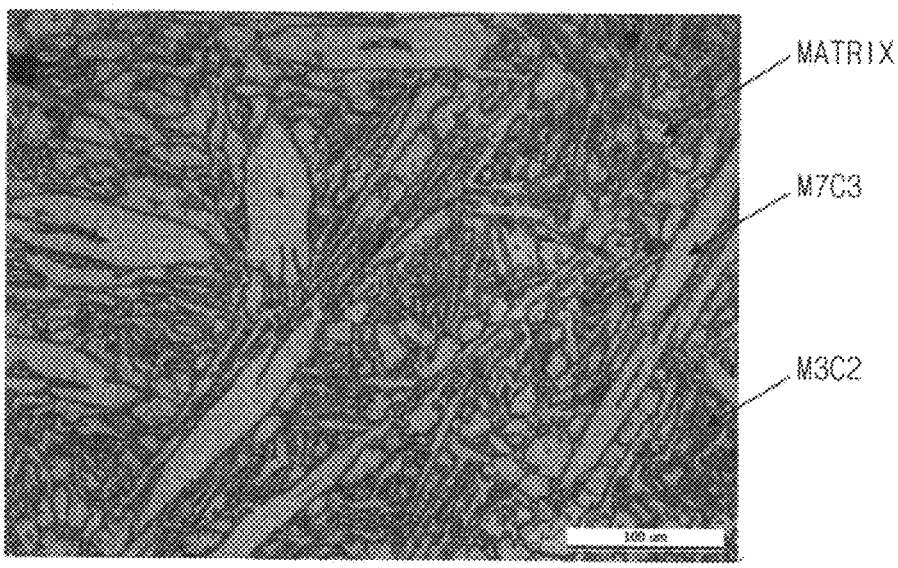
FIG. 9 is an image illustrating microstructures of the wear resistant tip in accordance with example embodiments.

FIG. 8 is an image illustrating microstructures of cast bonding portion between the wear resistant tip and the body manufactured according to Examples, and FIG. 9 is an image illustrating microstructures of the wear resistant tip manufactured according to Examples.

TABLE 1

| | Compositions (wt %) | | | | | | | | | |
|---|---|---|---|---|---|---|---|---|---|---|
| Type | C | Si | Mn | P | S | Cr | Mo | Ni | Cu | Fe |
| Ex. 1 | 2.70 | 0.71 | 0.76 | 0.015 | 0.009 | 20.3 | 0.72 | 0.52 | 0.21 | remainder |
| Ex. 2 | 3.29 | 0.90 | 0.87 | 0.020 | 0.013 | 15.5 | 0.80 | 0.71 | 0.28 | remainder |
| Ex. 3 | 3.18 | 0.49 | 0.65 | 0.021 | 0.009 | 24.1 | 0.64 | 0.45 | 0.02 | remainder |
| Ex. 4 | 2.47 | 0.92 | 0.94 | 0.011 | 0.021 | 24.3 | 0.87 | 0.69 | 0.24 | remainder |
| Ex. 5 | 2.41 | 0.43 | 0.66 | 0.029 | 0.019 | 15.8 | 0.68 | 0.47 | 0.10 | remainder |
| C. E. 1 | 2.626 | 0.72 | 0.81 | 0.011 | 0.02 | 18.3 | 0.74 | 0.71 | 0.11 | remainder |
| C. E. 2 | 3.45 | 0.72 | 0.72 | 0.013 | 0.01 | 15.3 | 0.74 | 0.50 | 0.22 | remainder |
| C. E. 3 | 2.17 | 0.92 | 0.96 | 0.020 | 0.015 | 24.8 | 0.85 | 0.65 | 0.22 | remainder |
| C. E. 4 | 3.21 | 0.92 | 0.95 | 0.021 | 0.019 | 24.7 | 0.76 | 0.93 | 0.19 | remainder |
| C. E. 5 | 2.72 | 1.30 | 0.79 | 0.013 | 0.009 | 19.3 | 0.71 | 0.479 | 0.24 | remainder |
| C. E. 6 | 2.43 | 0.41 | 0.50 | 0.019 | 0.014 | 16.4 | 0.68 | 0.42 | 0.20 | remainder |
| C. E. 7 | 3.21 | 0.89 | 0.75 | 0.011 | 0.019 | 24.2 | 1.19 | 0.45 | 0.02 | remainder |

Physical properties of the tooth point including the wear resistant tip manufactured according to Examples and Comparative Examples was measured, and Table 2 below shows measured results.

1) surface hardness: Rockwell hardness tester (150 kg) detection 2) wear amount of sand: ASTM G65-85 (Standard Practice for Conducting Dry Sand/Runner Wheel Abrasion Test) measurement 3) $K_{IC}$ (Fracture Toughness): MC measurement of ASTM E399

TABLE 2

| | Surface hardness (HRC) | Wear amount of sand ($mm^3$) | $K_{IC}$($MPam^{1/2}$) |
|---|---|---|---|
| Ex. 1 | 62.8 | 47.5 | 29.6 |
| Ex. 2 | 63.2 | 42.8 | 27.1 |
| Ex. 3 | 64.3 | 43.9 | 25.6 |
| Ex. 4 | 61.5 | 52.9 | 27.9 |
| Ex. 5 | 60.5 | 58.3 | 28.6 |
| C.E. 1 | 60.8 | 77.6 | 26.5 |
| C.E. 2 | 63.0 | 76.2 | 17.9 |
| C.E. 3 | 58.7 | 78.5 | 26.9 |
| C.E. 4 | 64.9 | 40.8 | 15.9 |
| C.E. 5 | 62.4 | 47.8 | 14.9 |
| C.E. 6 | 60.5 | 76.5 | 27.8 |
| C.E. 7 | 63.9 | 43.0 | 18.9 |
| Conventional Example | 63.6 | 118.4 | 15.6 |

In Table 2, Conventional Example represents a tooth cap including welded tungsten carbide disclosed in Korean Utility Model Publication No. 1999-011857 as stated in prior document.

Referring to Table 2, tooth point (wear resistant tip) manufactured according to Examples 1 to 5 has high hardness of HRC 60 to 65 and wear resistance and fracture toughness have been improved when compared with Comparative Examples. For example, wear resistance according to Examples has been improved more than two times than Conventional Example and fracture toughness according to Examples has been improved up to 89%.

On the other hand, in Comparative Example 1, a full annealing was omitted, and $M_3C$ was not precipitated and thus wear resistance was deteriorated. In Comparative Example 2, as an amount of carbon was increased excessively, the wear amount was increased. This was because an amount of carbon distributed in a matrix was increased relatively so that ferrite was formed in the matrix and austenite was reduced drastically so that properties of holding carbide were decreased. In Comparative Example 3, the amount of carbon in comparison with chrome was not sufficient so that carbide was not formed sufficiently, and thus, hardness was decreased and fracture toughness was decreased. In Comparative Example 4, an amount of nickel was increased and thus hardenability was increased and fracture toughness was decreased. In Comparative Example 5, an amount of silicon was increased to cause cast defect, and thus fracture toughness was deteriorated. In Comparative Example 6, an amount of manganese was not sufficient during the full annealing process $M_3C$ precipitation was not induced and thus wear amount was increased. In Comparative Example 7, an amount of molybdenum was increased excessively, the amount distributed in a matrix besides carbide formation was increased relatively compared to the amount of the $M_7C_3$ carbide and thus brittleness may be increased and fracture toughness was deteriorated.

Referring to the Examples and Comparative Examples, the white cast iron including the compositions in accordance with example embodiments may be applied and a full annealing process may be performed to obtain the wear resistant tip having improved wear resistance performance which satisfies working properties of construction machinery, for example, fracture toughness of 25 $MPam^{1/2}$.

Figure 10:
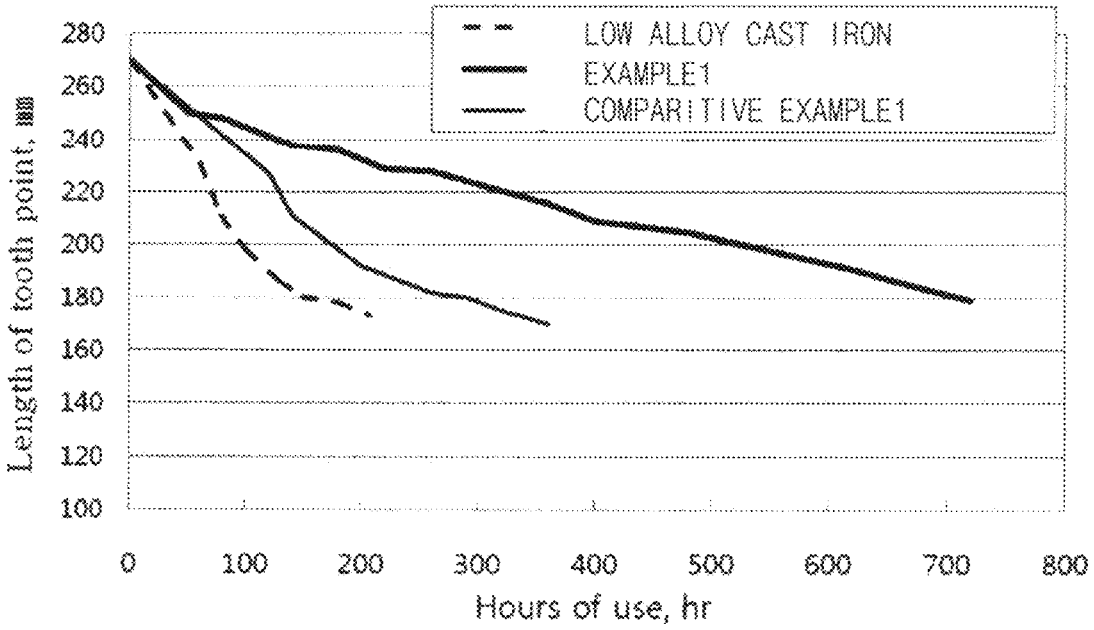
FIG. 10 is graphs illustrating wear resistance test results of bucket parts for construction machinery manufactured according to Example and Conventional Examples.

FIG. 10 is graphs illustrating wear resistance test results of bucket parts for construction machinery manufactured according to Example and Conventional Examples.

In particular, a tooth point including the wear resistant tip of Example 1, a tooth point according to Conventional Example, and a tooth point with low alloy cast iron including carbon of 0.3 wt % were combined with buckets of wheel loaders, respectively. Then, the wheel loaders were used to perform works, and then a change in a length of each of the tooth points over time was measured. FIG. 10 represents measured results.

Referring to FIG. 10, a lift time of the tooth point including the wear resistant tip of Example 1 was improved more than two times than the tooth point according to Conventional Example, and was improved more than three times than the tooth point with low alloy cast iron in general use.

INDUSTRIAL APPLICATION

The bucket part for construction machinery in accordance with example embodiments may be applied for an auxiliary part for construction machinery such as a tooth point, a shroud, a cutter, etc, to thereby improve durability and working efficiency of the construction machinery.

The present invention has been explained with reference to preferable embodiments, however, those skilled in the art may understand that the present invention may be modified or changed without being deviated from the concept and the scope of the present invention disclosed in the following claims.

THE DESCRIPTION OF THE REFERENCE NUMERALS

100: body 100*a*: first surface
100*b*: second surface 110: inserting portion
115: concave portion 120: inserting column
130: first recess 200: first wear resistant tip
210, 310: hole 240: second recess
250: second wear resistant tip 300: wear resistant tip

The invention claimed is:

1. A bucket part for construction machinery being coupled with a bucket of the construction machinery, the bucket part for construction machinery comprising:

a body including at least one seating portion in a surface thereof; and a wear resistant tip cast bonded to the at least one seating portion, wherein the body and the wear resistant tip include dissimilar cast irons, wherein the at least one seating portion includes an inserting column, and the wear resistant tip includes a hole into which the inserting column is inserted when combining with the at least one seating portion, and wherein a thickness of the inserting column increases gradually from a surface of the at least one seating portion.

2. The bucket part for construction machinery of claim 1, wherein the body comprises a low alloy cast iron including carbon in a range from 0.25 weight percent to 0.36 weight percent based on a total weight of the body.

3. The bucket part for construction machinery of claim 2, wherein the body has Brinell hardness (HB) of from 490 to 550, and the wear resistant tip has Rockwell hardness (HRC) of from 60 to 65.

4. The bucket part for construction machinery of claim 1, wherein the bucket part for construction machinery is provided as a tooth point, a shroud or a cutter.

5. The bucket part for construction machinery of claim 1, wherein a surface of the wear resistant tip which forms a cast bonding surface when cast bonded to the seating portion has a convex curve.

6. The bucket part for construction machinery of claim 1, wherein the at least one seating portion includes a first recess in a bottom surface of the body and a second recess in an upper surface of the body, and wherein the wear resistant tip includes a first wear resistant tip cast bonded into the first recess and a second wear resistant tip cast bonded into the second recess.

7. The bucket part for construction machinery of claim 1, wherein the wear resistant tip includes a white cast iron, and the white cast iron includes carbon (C) in a range from 2.3 weight percent to 3.3 weight percent, chrome (Cr) in range from 15 weight percent to 25 weight percent, silicon (Si) in a range from 0.4 weight percent to 1.0 weight percent, manganese (Mn) in a range from 0.6 weight percent to 1.0 weight percent, molybdenum (Mo) in a range from 0.6 weight percent to 1.0 weight percent, nickel (Ni) in a range from 0.4 weight percent to 0.8 weight percent, copper (Cu) in a range from 0.0 weight percent to 0.3 weight percent, inevitable impurities, and a remainder of iron (Fe) based on a total weight of the wear resistant tip.

* * * * *